US006673530B2

(12) United States Patent
Saito

(10) Patent No.: US 6,673,530 B2
(45) Date of Patent: Jan. 6, 2004

(54) METHOD AND APPARATUS FOR PRODUCTION OF SILVER HALIDE EMULSION

(75) Inventor: Hirokazu Saito, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/259,865

(22) Filed: Sep. 30, 2002

(65) Prior Publication Data

US 2003/0064012 A1 Apr. 3, 2003

(30) Foreign Application Priority Data

Sep. 28, 2001 (JP) ..... 2001-299399

(51) Int. Cl.[7] ..... G03C 1/025
(52) U.S. Cl. ..... 430/569
(58) Field of Search ..... 430/569

(56) References Cited

U.S. PATENT DOCUMENTS

| | | | | |
|---|---|---|---|---|
| 3,782,954 A | 1/1974 | Porter et al. | ..... | 430/642 |
| 4,289,733 A | 9/1981 | Saito et al. | ..... | 422/227 |
| 5,484,697 A | 1/1996 | Mignot et al. | ..... | 430/569 |
| 5,549,879 A | 8/1996 | Chow | ..... | 423/491 |

FOREIGN PATENT DOCUMENTS

| | | | |
|---|---|---|---|
| JP | 55-10545 B2 | 3/1980 | |
| JP | 62-275023 A | 11/1987 | |
| JP | 4-283741 A | 10/1992 | |
| JP | 6-507255 A | 8/1994 | |
| JP | 7-219092 A | 8/1995 | |
| JP | 8-22739 B2 | 3/1996 | |
| JP | 8-171156 A | 7/1996 | |
| JP | 2000-292878 A | 10/2000 | |

*Primary Examiner*—Hoa Van Le
(74) *Attorney, Agent, or Firm*—Birch, Stewart, Kolasch & Birch, LLP

(57) ABSTRACT

Variation of charged amount accompanying production amount change does not affect photograph performance, a flexible production of an optimal amount corresponding to commercial scene needs may be performed, and a silver halide emulsion having monodispersibility may be produced with sufficient productivity. In the first line a series of continuous operations are performed that a silver salt aqueous solution, a halide salt aqueous solution, and a hydrophilic dispersion medium aqueous solution are mixed and reacted to generate silver halide grain nuclei, and a mother liquor containing the silver halide grain nuclei is stored in cooled state until a amount of production reaches a desired production amount of a silver halide emulsion. A series of continuous operations are performed at least once that when an amount of formation reaches the desired production amount, the cooled mother liquor is ultra-filtrated in the third line to eliminate, to dehydrate, and to concentrate unnecessary salt generated in the formation reaction, and the mother liquor after ultra-filtrated and an addition liquid containing silver halide ultrafine grains prepared in the second line are instantaneously mixed continuously to grow the silver halide grain nuclei.

4 Claims, 4 Drawing Sheets

METHOD AND APPARATUS FOR PRODUCTION OF SILVER HALIDE EMULSION

This nonprovisional application claims priority under 35 U.S.C. §119(a) on Patent Application No. 2001-299399 filed in Japan on Sep. 28, 2001, which is herein incorporated by reference.

BACKGROUND OF THE INVENTION

1. Field of the Invention

The present invention relates to a method for production of silver halide emulsion producing a silver halide emulsion for photographs comprising silver halide grains, and to an apparatus therefor.

2. Description of the Related Art

Various proposals have been provided about technology for producing halogenated grains of a silver halide emulsion for photographs. In formation generally adopted for silver halide grains, a reaction chamber having agitating and mixing equipment is provided in a reactor containing a gelatin aqueous solution, and a silver salt aqueous solution and a halide salt aqueous solution are introduced to this reaction chamber, crystal grain nuclei are formed, and grain growth by physical aging is performed in the reactor.

Usually, grain formation is performed by causing a reaction between silver ion and halide ion in a reaction container having a sufficient volume equipped with an agitator having agitating blades. In this case, efficiency of agitation in the reaction container is important, and for example, agitation methods of various forms as described in Japanese Patent Application Publication Nos. 7-219092, 8-171156 and 4-283741, Japanese Patent Publication Nos. 8-22739 and 55-10545, and U.S. Pat. No. 3,782,954, etc. are proposed.

In order to form silver halide grains (for example, grains having high monodispersibility, grains having high flat platy ratio in case of tabular grains, etc.) that are preferable as silver halide emulsion for photographs, one of functions for which these agitators are required is uniform and instantaneous micro-mixing. In order to realize uniform mixing, a method is often adopted that a silver salt aqueous solution and a halide salt aqueous solution added are diluted using liquid that has already existed in a reaction container before a reaction between both of the solution. However, when sufficient dilution is not performed in this method, usually a silver halide grain emulsion thus obtained is not preferable as photosensitive materials for photographs.

For example, if agitation is inadequate upon addition in a nucleation period in preparation of tabular grains and a solution added is not fully diluted, phenomena such as an increase in percentage of non-parallel three-dimensional twin crystals, or polydispersion of tabular grains, etc. are observed in grown grains. This can be confirmed by decreasing agitation rotational frequency using an agitator given in Japanese Patent Publication No. 55-10545.

In the case where dilution is inadequate in a growth period, new nuclei are formed from a vicinity of an addition opening, and they do not dissolve completely, and as a result, grains formed in a growth period contaminate silver halide grain emulsion obtained. Such a phenomenon especially is notably seen, when high supersaturation growth is performed.

It is thus considered that agitation is important and it is preferable to fully adopt dilution by a bulk liquid. However, usually already formed grain is included in a bulk liquid, and then a problem of recirculation arises that grains formed once circulate in the vicinity of the addition liquid again. If recirculation occurs in a nucleation period, nuclei that are recycled will block formation of new nuclei. Therefore, for example, in order to prepare a grain emulsion having a small grain diameter, even if an amount added for nucleation is increased, a corresponding increase in the number of nuclei may not be realized, but bad influence is given to realize a small grain diameter. Also when monodispersed grain emulsion is to be prepared, since grain diameter difference arises between nuclei that grew by recirculation and nuclei that did not so, polydispersion of nuclei by recirculation arises, which gives bad influence.

In order to solve these problems, a method is proposed in which fine grains prepared beforehand are used for nuclei forming process, nuclei growth process, etc. In this method, a silver salt aqueous solution, a halide salt aqueous solution, and in many cases, a dispersion medium aqueous solution are usually added into a reaction container with a small volume, and while being added, operation of removing fine grains from the reaction container exit is performed continuously in parallel. Fine grains can be used for nucleation and/or nuclei growth.

If this method is used for nucleation, since the problem of recirculation can be controlled, there is an advantage that increase in the number of nuclei may be realized comparatively easily. In order to make the number of nuclei increase as much as possible, it is desirable to make a grain diameter of nuclei formed as small as possible. However, since an agitator used by this method cannot utilize dilution effect by the above described bulk liquid, more powerful agitation is required in order to perform sufficient mix. When agitation is inadequate, for example, in case of preparation of a tabular grain emulsion, a problem of unwilled increase in a ratio of contaminating non-tabular grains occurs. For example, a ratio of non-tabular grains increases as compared with a case where bulk liquid circulation exists in a mixing apparatus described in Japanese Patent Application Publication No. 6-507255 corresponding to U.S. Pat. No. 5,484,697.

In order to obtain a desired silver halide crystal grains based on these facts, it is important to control exactly a number of generation of crystal nuclei, nuclei shape, etc., and for that purpose, various conditions, such as agitation rotational frequency, addition liquid concentration, addition flow rate, amount of solutions that exists in a reactor beforehand, and liquid composition also, need to be properly determined. However, if a production amount, i.e., charged amount, is changed in grain formation in conventional methods, proper various conditions will be varied based on a charged amount, and thereby it is practically difficult to obtain a same grain performance.

On the other hand, according to commercial scene needs in recent years, condition of production is in a situation that diversification of needs forces production of a small amount of lot of products with many forms by a same manufacturing apparatus. Consequently, a scale of a reactor forming a silver halide grains is not necessarily in accord with an amount of scale of production lot unit, and therefore change in a scale of an amount of production in a same reactor provides a resultant factor to vary photograph performance.

There is a method disclosed in Japanese Patent Application Publication No. 2000-292878 as a formation method of silver halide grains in which photograph performance variation is not provided even if charged amount is varied. This is a method for forming silver halide grains using an apparatus having an addition opening of a silver salt aqueous solution and a halide salt aqueous solution to a reaction chamber, the reaction chamber having an agitator in a reaction tank filled with a gelatin solution, and performing grain growth within the reaction tank, wherein a part of reaction in which nucleation is mainly performed is carried out within a mixer currently disposed out of the reaction tank while not having agitator, and subsequently, grain growth is performed after this liquid is introduced into the reaction tank.

However, the method of Japanese Patent Application Publication No. 2000-292878 is a so-called batch tank method, in which grain nuclei formed outside of the reaction tank is stored in one reaction tank, and a silver salt aqueous solution and a halide salt aqueous solution for growing are added into this reaction tank, and subsequently the grain nuclei existing in the reaction tank are grown. Therefore, there occurs a problem that the silver salt aqueous solution and the halide salt aqueous solution added cannot deposit instantaneously to each of the grain nuclei existing in the reaction tank, and thus, practically it is impossible to uniformly grow the grain nuclei.

That is, according to probable consideration, a frequency is small in which grain nuclei existing in a reaction tank have collisional association with ultrafine grains for growth supplied into a reaction tank, in a grain growth method by conventional batch tank methods. Therefore, when a capacity of a reaction tank is large enough as compared to a charged amount, mixing cannot be started actually in an instant, and as a result, grain nuclei and ultrafine grains without any collisional association at all may be formed depending on case. According to this consideration, it is a phenomenon that may happen naturally that a particle size distribution becomes larger by a grain growth method by a batch tank method, and this is unavoidable. Therefore, also in the method of Japanese Patent Application Publication No. 2000-292878, a problem is fundamentally unsolvable that a larger production scale enlarges a grain size distribution.

SUMMARY OF THE INVENTION

The present invention is made in order to cancel conventional disadvantage in view of such a situation, and aims at providing a method for production of a silver halide emulsion and an apparatus thereof, in which variation of charged amount accompanying production amount change does not fluctuate photograph performance, flexible production of an optimal amount corresponding to commercial scene needs is attained, and a silver halide emulsion having monodispersibility may be produced with sufficient productivity.

In order to attain the above described objective, the present invention is directed to a method for production of silver halide emulsion, comprising; a grain nuclei forming step of performing a series of continuous operations comprising continuously, instantaneously mixing and causing reaction of a silver salt aqueous solution, a halide salt aqueous solution, and a hydrophilic dispersion medium aqueous solution to form a silver halide grain nuclei, and storing a mother liquor containing the silver halide grain nuclei in a cooled state until the amount of nuclei reaches a desired production amount of the silver halide emulsion; and a grain nuclei growing step of performing at least one series of continuous operation comprising filtering the cooled mother liquor to eliminate unnecessary salt generated in the formation reaction, and to dehydrate and concentrate the filtered mother liquor when the amount of product reaches a desired production amount, and continuously, instantaneously mixing the mother liquor after filtrated and an addition liquid containing silver halide ultrafine grains for growth obtained separately by mixing and reacting a silver salt aqueous solution, a halide salt aqueous solution, and a hydrophilic dispersion medium aqueous solution to grow the silver halide grain nuclei.

In another aspect, in order to attain the above described objective, the present invention is also directed to an apparatus for production of a silver halide emulsion, comprising; a first line in which a silver salt aqueous solution, a halide salt aqueous solution, and a hydrophilic dispersion medium aqueous solution are continuously introduced into an instantaneous mixing reactor of continuous system to form silver halide grain nuclei continuously, and a mother liquor containing the silver halide grain nuclei formed is continuously discharged from the instantaneous mixing reactor, and is stored in a cooled tank; a second line in which an addition liquid containing silver halide ultrafine grains for growth is continuously prepared by mixing a silver salt aqueous solution, a halide salt aqueous solution, and a hydrophilic dispersion medium aqueous solution using an instantaneous mixer of continuous system; and a third line in which the mother liquor stored in the cooled tank is continuously filtrated with a filter to eliminate unnecessary salt generated in the formation reaction of the grain nuclei, and to dehydrate and concentrate the mother liquor, and the mother liquor after filtrated and the addition liquid prepared by the second line are mixed instantaneously by the instantaneous mixer of continuous system and discharged into an aging storage tank.

According to the present invention, in a grain nuclei forming process, a series of continuous operations for forming silver halide grain nuclei by instantaneously mixing and causing reaction of a silver salt aqueous solution, a halide salt aqueous solution, and a hydrophilic dispersion medium aqueous solution, and for storing a mother liquor containing the silver halide grain nuclei in cooled state until the amount of nuclei reaches a predetermined amount of silver halide emulsion product. Thereby since uniform and instantaneously mixing reaction may be performed, and the mother liquor does not recycle into a reaction area in the mixing reaction, formation of silver halide grain nuclei having small diameters with even sizes may be promoted. Since the mother liquor containing formed silver halide grain nuclei is stored in cooled state until the amount of product reaches the desired production amount of a silver halide emulsion, growth of the grain nuclei is controlled until a following grain nuclei growing process is performed. Therefore, in the grain nuclei forming process, a stable formation of silver halide grain nuclei having a small diameter and a uniform size may be performed regardless of variation of charged amount.

Next a series of continuous operations are performed at least once that when the amount of product reaches the desired production amount in a grain nuclei growing process, the cooled mother liquor is filtrated to eliminate, to dehydrate, and to concentrate unnecessary salt generated in the formation reaction, and the mother liquor after filtrated and an addition liquid containing silver halide ultrafine grains for growth obtained separately by mixing and reacting a silver salt aqueous solution, a halide salt aqueous solution, and a hydrophilic dispersion medium aqueous solution are instantaneously mixed continuously to grow the above described silver halide grain nuclei. That is, unnecessary salts that adversely affects stability of formed silver halide grain nuclei, such as unreacted silver salts, unreacted halide salts, by-product salts formed by reaction are eliminated by filtration processing of the mother liquor. This mother liquor after filtrated, and the addition liquid containing silver halide ultrafine grains for grain nuclei growth prepared separately are instantaneously mixed continuously, and growth of grain nuclei is performed. According to the above described method, growth of silver halide grain nuclei is performed uniformly and instantaneously, and moreover if the mother liquor once passes through an area where the mother liquor and the addition liquid are instantaneously mixed, i.e. growth area of grain nuclei, the mother liquor will not pass through the growth range again unless a series of continuous operations are performed next. When a particle diameter of the silver halide grain nuclei is smaller than the desired particle diameter after one time of grain nuclei growing process, a series of continuous operations are repeated until the diameter becomes the desired particle diameter. Therefore, a uniform growth of grain nuclei can be attained regardless of a charged amount.

Thereby variation of charged amount accompanying production amount change does not fluctuate photograph performance, flexible production of an optimal amount corresponding to commercial scene needs is attained, and the silver halide emulsion having monodispersibility may be produced with sufficient productivity.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Hereinafter a method for production of a silver halide emulsion of the present invention, and preferable embodiments of apparatus will be described in full detail using accompanying drawings.

Figure 1:
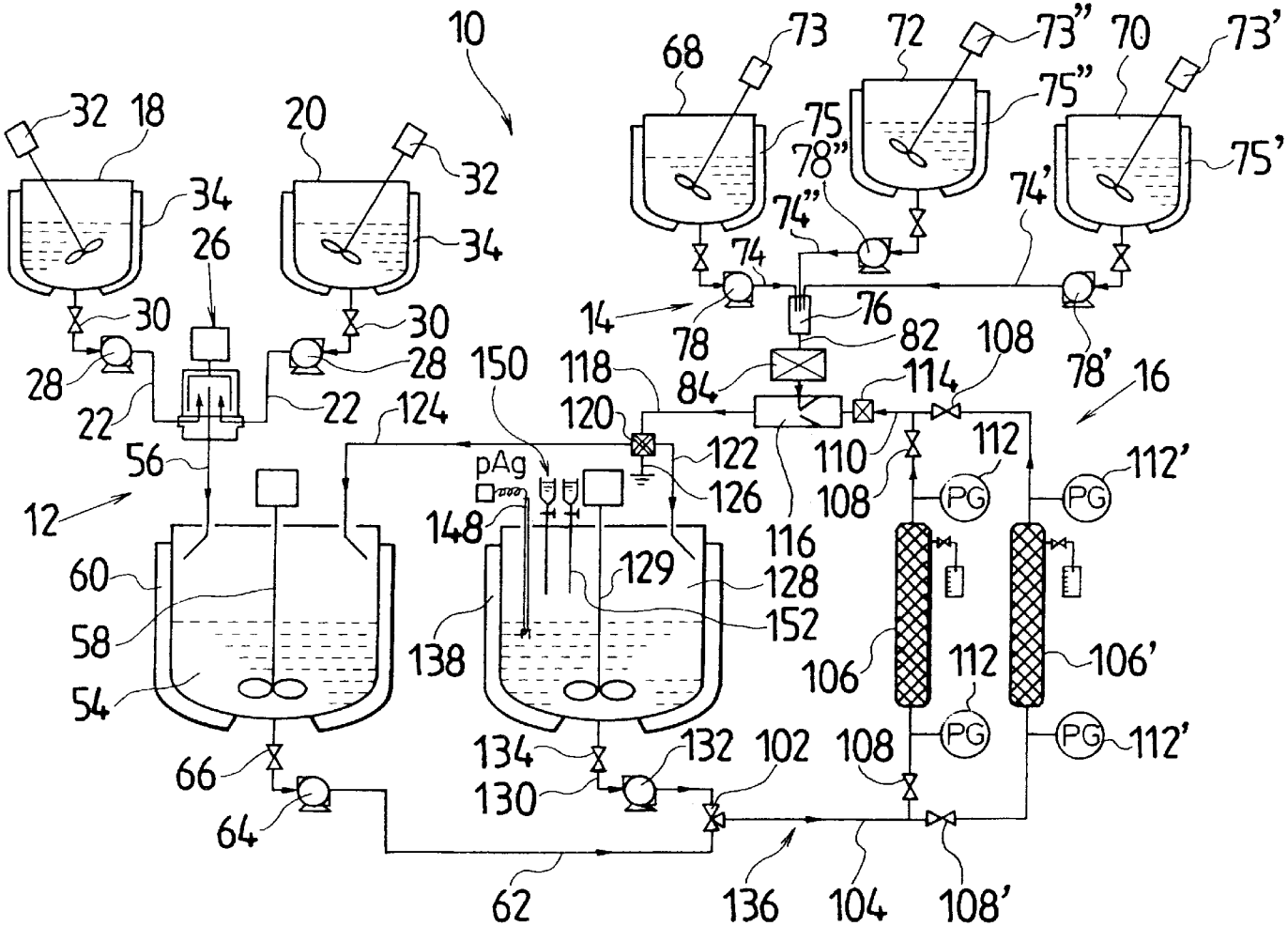
FIG. 1 is a whole manufacturing apparatus block diagram of a silver halide emulsion of the present invention.

FIG. 1 shows a whole block diagram showing an embodiment of manufacturing apparatus of a silver halide emulsion of the present invention.

Manufacturing apparatus 10 of the present invention is mainly constituted by a first line 12 in which silver halide grain nuclei are formed and a mother liquor containing the grain nuclei is stored in cooled state, a second line 14 in which an addition liquid containing silver halide ultrafine grains for growing the silver halide grain nuclei is prepared, and a third line 16 in which the mother liquor and the addition liquid are mixed instantaneously to grow silver halide grain nuclei.

In the first line 12, a first silver salt tank 18 storing a silver salt aqueous solution and a first halide salt tank 20 storing a halide salt aqueous solution containing gelatin are connected to an instantaneous mixing reactor 26 through each piping 22 and 22, liquid sending pumps 28 and 28, and valves 30 and 30 controlling an amount of liquid sending are disposed to each piping 22 and 22. Agitators 32 and 32 agitating solution, and temperature control jackets 34 and 34 controlling a liquid temperature are provided to the first silver salt tank 18 and the first halide salt tank 20.

Figure 2:
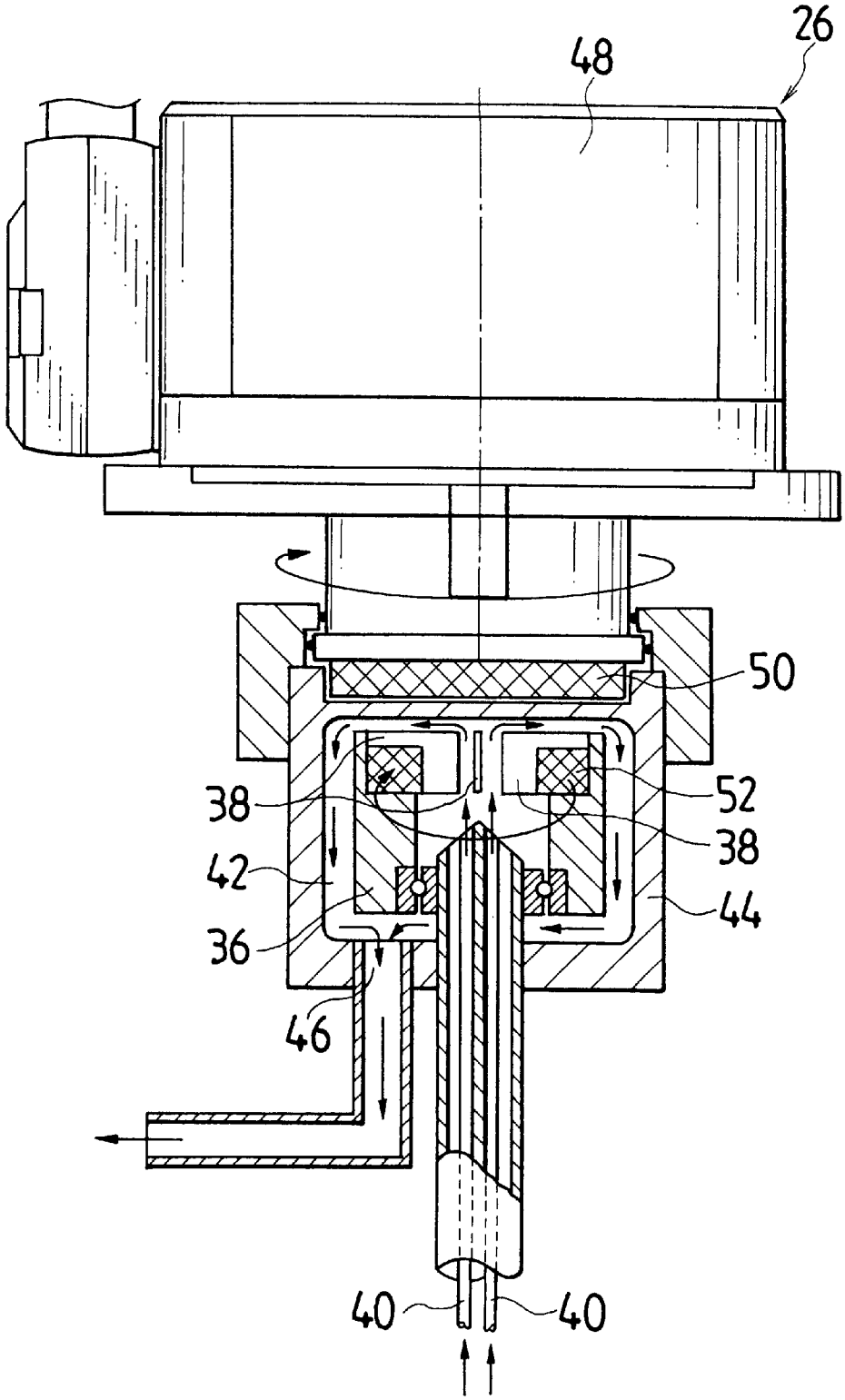
FIG. 2 is a sectional view of an instantaneous mixing reactor.

As an instantaneous mixing reactor 26, equipment shown in Japanese Patent Application No. 2000-103428 (corresponding to Japanese Patent Application Publication No. 2001-286745, which was, at the time the present invention was made, not published, not publically known, and assigned to the same assignee to which the present invention was subject to an obligation of assignment) can be suitably used. This instantaneous mixing reactor 26 is constituted as is shown in FIG. 2. That is, two or more of liquids or solutions are delivered from each nozzle tubing 40 and 40 to a rotating area in an inner tub 36 formed by an agitating blade 38 and 38 . . . rotating with the inner tub 36 that rotates at high-speed, and agitated and mixed, and thereby instantaneous agitation and mixing is attained to form a turbulent flow state of a mixed liquor. The resultant mixed liquor having a state with uniform concentration obtained accompanies to a flow from the inner tub 36 to a crevice 42 formed by agitation of the agitating blade 38, and it immediately flows out of the inner tub 36, and flows via the crevice 42 and is discharged from an outlet 46 formed in a base of outside tub 44. High-speed rotation of the inner tub 36 is performed by magnetic coupling between an external magnet 50 rotated by a motor 48, and an internal magnet 52 provided in the inner tub 36.

As is shown in FIG. 1, a cooled tank 54 is disposed under the instantaneous mixing reactor 26, a mother liquor containing silver halide grain nuclei continuously formed in the instantaneous mixing reactor 26 is continuously sent to the cooled tank 54 from an exhaust pipe 56. An end of the discharge pipe 56 is installed near an internal surface of the cooled tank 54, and constituted so that a liquid discharged through the discharge pipe 56 may flow via a surface of the cooled tank 54 and fall into the cooled tank 54 without any foaming. An agitator 58 is installed in this cooled tank 54, and a temperature control jacket 60 that cools the mother liquor in the cooled tank 54 encloses a circumference so that growth of silver halide grain nuclei may not progress. The mother liquor in the cooled tank 54 is sent to the third line 16 through a piping 62 prolonged from a bottom of the cooled tank 54, and a liquid sending pump 64 and a valve 66 that controls an amount of liquid sending are provided in the piping 62.

In the first line 12 constituted in this way, a series of continuous operations are performed that a silver salt aqueous solution, and a halide salt aqueous solution containing gelatin are mixed and reacted instantaneously by the instantaneous mixing reactor 26 to form silver halide grain nuclei, and that the mother liquor containing the silver halide grain nuclei is stored in cooled state in the cooled tank 54 until the amount reaches a desired amount of production silver halide emulsion.

In the second line 14, a second silver salt tank 68 storing a silver salt aqueous solution, a second halide salt tank 70 storing a halide salt aqueous solution, and a dispersion medium tank 72 storing a hydrophilic dispersion medium aqueous solution, such as gelatin aqueous solution, are connected to a continuous mixer 76 of ultra high-speed jet method through each piping 74, 74', and 74", and liquid sending pumps 78, 78', and 78". Agitators 73, 73', and 73", and temperature control jackets 75, 75', and 75" controlling liquid temperature are provided in the second silver salt tank 68, the second halide salt tank 70, and the dispersion medium tank 72. A discharge pipe 82 of the continuous mixer 76 is connected to high efficiency heat exchanger 84 of micro reactor type.

In the second line 14 constituted in this way, the silver salt aqueous solution, and the halide salt aqueous solution and the hydrophilic dispersion medium aqueous solution are mixed instantaneously and reacted by the continuous mixer 76 to form silver halide ultrafine grains for growing the silver halide grain nuclei formed in the first line 12. An addition liquid containing the silver halide ultrafine grains is sent to the third line 16 after the liquid temperature is controlled by the high efficiency heat exchanger 84.

Figure 3:
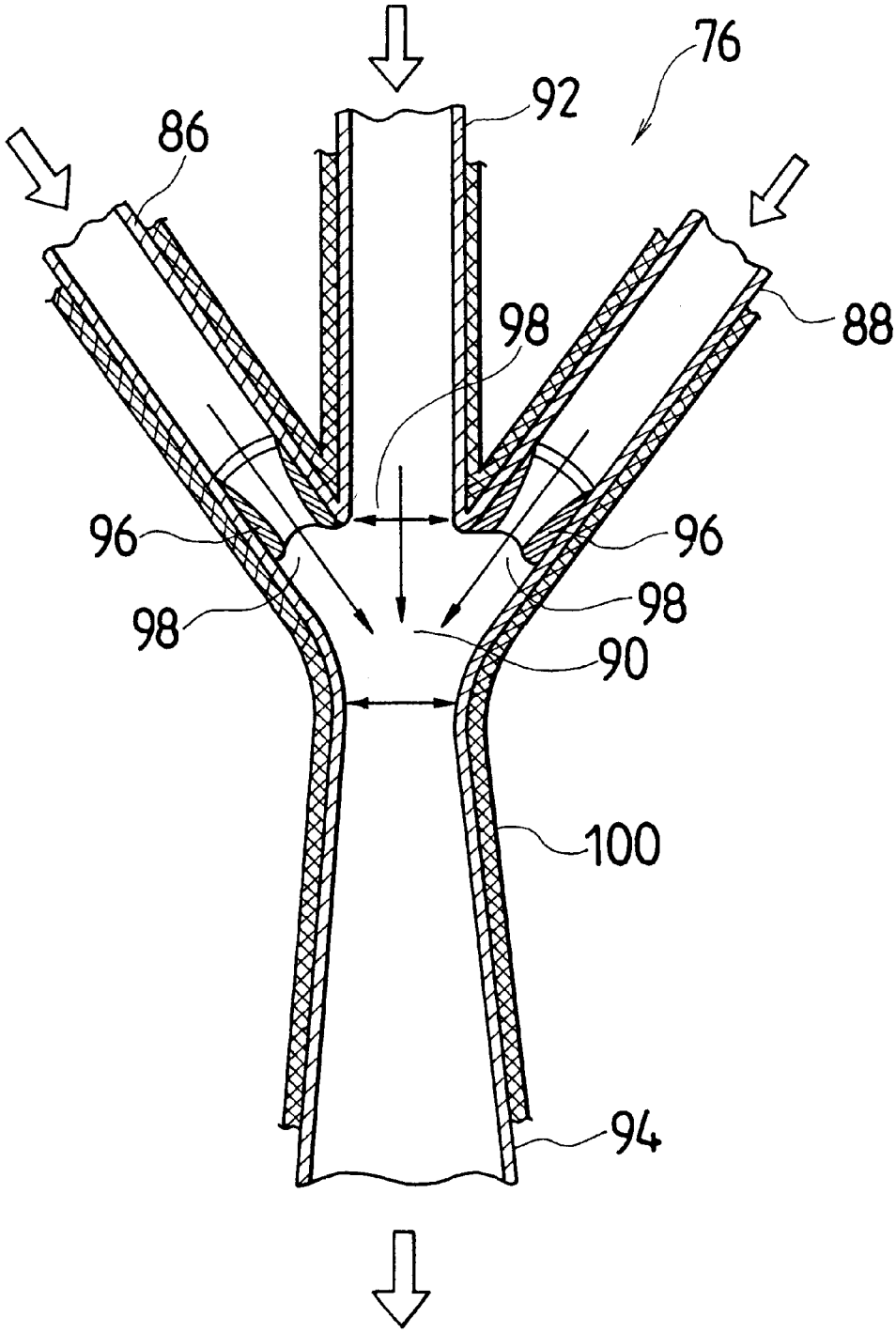
FIG. 3 is a sectional view of a continuous mixer of ultra high-speed jet method.

As a continuous mixer 76 of ultra high-speed jet method, a continuous mixing apparatus proposed by the present inventor in Japanese Patent Application No. 2000-104440 (corresponding to Japanese Patent Application Publication No. 2001-290231 and U.S. patent application Ser. No. 09/825,942, which was, at the time the present invention was made, not published, not publically known, and assigned to the same assignee to which the present invention was subject to an obligation of assignment) may be suitably used. This continuous mixer 76 shown in FIG. 3 is constituted so that mixing function is generated in junction area 90 by kinetic energy of a fluid caused by being met in a junction area 90 of a high-speed jet of the silver salt aqueous solution from a first small tube 86 and a high-speed jet of the halide salt aqueous solution from a second small tube 88, the hydrophilic dispersion medium aqueous solution is continuously supplied from a third small tube 92 into a middle portion of the above described two high-speed jets being met to instantaneously mix the three kinds of solutions in the junction area 90. Subsequently, the silver halide fine grains generated in a reaction by mixing are immediately discharged from a discharge pipe 94. In addition, referential numeral 96 shows an orifice, and 98 shows a discharging port and 100 shows a condenser.

As a high efficiency heat exchanger 84 of micro reactor type, IMM (Germany) "MINIATURIZED COUNTERCURRENT PLATE-TYPE HEAT EXCHANGER" may be suitably used.

In a third line 16 shown in FIG. 1, piping 62 currently installed from the cooled tank 54 of the first line 12 is connected to a inflow side of an ultrafilters 106 and 106' through a piping 104 and a cross valve 102. The ultrafilter 106 is disposed by two-set in parallel and switched by valves 108 and 108', pressure gauges 112 and 112' are installed in the piping 104 and 110 in sides of inflow and outflow of the ultrafilter 106. Thereby, when a filtration pressure of one of the ultrafilters 106 reaches a predetermined pressure, it is switched to the ultrafilter 106 of another side. A piping 110 by a side of outflow of the ultrafilter 106 is connected to an inflow side of a venturi tube type in-line mixer 116 through a heat exchanger 114, and the second line 14 is connected to an addition side of the in-line mixer 116. Thereby, the mother liquor filtrated with the ultrafilter 106 which liquid temperature was controlled with the heat exchanger 114, and the addition liquid prepared in the second line 14 was which liquid temperature was controlled by a high efficiency heat exchanger 84 are instantaneously mixed. Accordingly, the silver halide grain nuclei in the mother liquor and the ultrafine grains in the addition liquid are collided and associated together to promote growth of the grain nuclei, and grown grain nuclei are discharged from a piping 118 connected to an outflow side of the in-line mixer 116, without back mixing. The piping 118 is connected to four way valve 120, and moreover three pipings 122, 124, and 126 branches from the four way valve 120. One of the piping 122 is installed to an aging storage tank 128, a piping 130 prolonged from a lower part of the aging storage tank 128 is connected to the above described cross valve 102, and a liquid sending pump 132 and a valve 134 are provided in the piping 130. Thus a circulation line 136 that returns to the ultrafilter 106; ultrafilter 106→heat exchanger 114→in-line mixer 116→four way valve 120→aging storage tank 128→ultrafilter 106 is formed. When the mother liquor and the addition liquid are mixed instantaneously only once to grow grain nuclei using the in-line mixer 116, the four way valve 120, and the cross valve 102 are operated in order not to flow the liquid stored in the aging storage tank 128 in the circulation line 136 again. When the mother liquor and the addition liquid are mixed instantaneously two or more times to grow grain nuclei using the in-line mixer 116, the four way valve 120 and the cross valve 102 are operated in order to flow the liquid stored in the aging storage tank 128 in the circulation line 136 again. That is, if the mother liquor passes through the growth area of grain nuclei once, operation will be performed so that the mother liquor may not pass through the growth area unless a series of continuous operations are performed next. When a particle diameter of silver halide grain nuclei is smaller than the desired particle diameter only by passing the growth area once, a series of continuous operations are repeated until it gives the desired particle diameter.

Other piping 124 of the four way valve 120 is installed to the cooled tank 54 of the above described first line 12, when the four way valve 120 is switched to the cooled tank 54 side from the aging storage tank 128 side, liquid that flows circulation line 136 will be sent to the cooled tank 54. Thereby, when the mother liquor and the addition liquid are mixed instantaneously two or more times using the in-line mixer 116, liquid that finished a last instantaneous mixing may be sent to the cooled tank 54. In this case, a constitution in which another tank is provided in the third line 16 may be adopted, without using the cooled tank 54 for both of the first line 12 and the third line 16. A last piping 126 of the four way valve 120 is used for gathering of sample liquid. Ends of the pipings 122 and 124 that lead to the aging storage tank 128 and the cooled tank 54 are placed near the tank internal surface so that liquid may flow via the tank internal surface, and an agitator 129 is installed also for the aging storage tank 128, and a temperature control jacket 138 encloses circumference of the tank.

Figure 4:
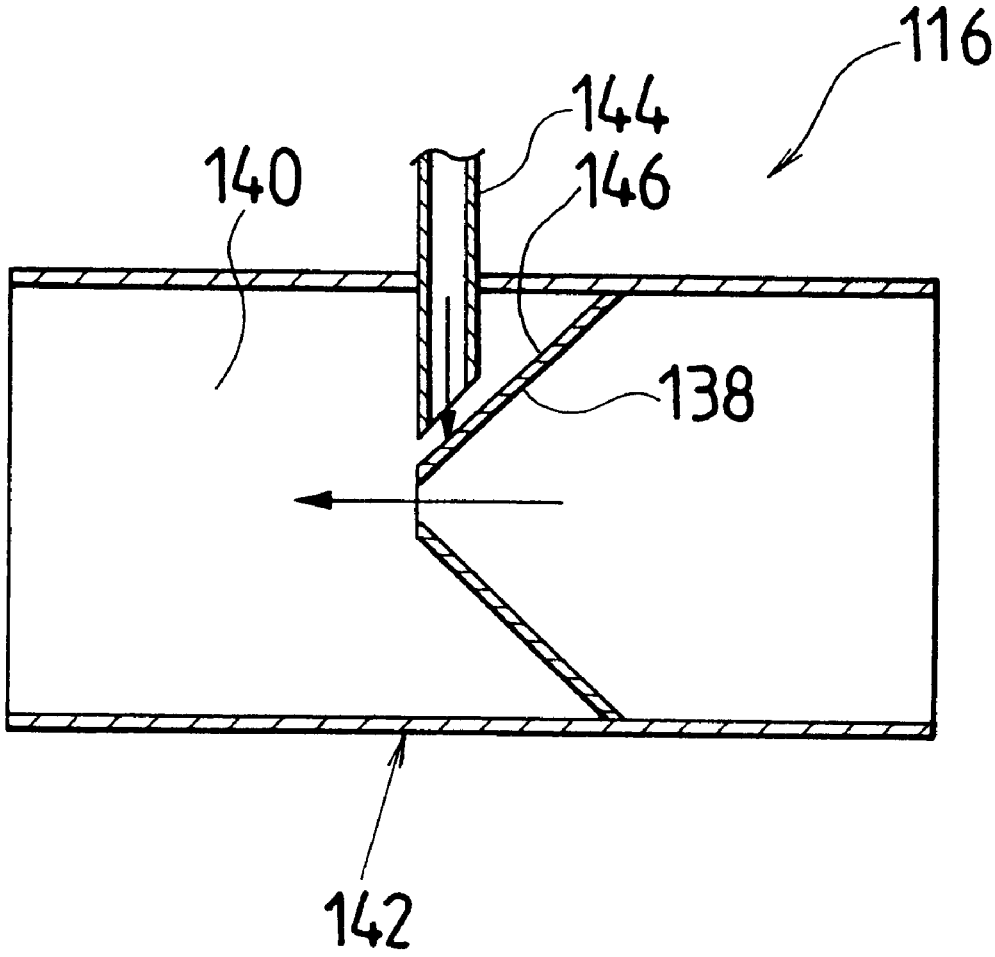
FIG. 4 is a sectional view of a venturi tube type in-line mixer.

FIG. 4 is a sectional view of a venturi tube type in-line mixer 116. This is constituted with a venturi tube 142 that ejects a mother liquor filtrated with the ultrafilter 106 which liquid temperature was adjusted from a convergent nozzle 138 to a space having a large diameter 140, and with an addition nozzle 144 to eject the addition liquid from the second line 14. Moreover, the convergent nozzle 138 and the addition nozzle 144 are arranged so that the direction of ejection may intersect perpendicularly, and they are arranged so that the addition liquid ejected out from the addition nozzle 144 may be ejected towards a slope 146 of the convergent nozzle 138. Reynolds number of a liquid flow in this in-line mixer 116 is preferably set no less than 2300, and a diameter of the convergent nozzle 138 is preferably set so that the ejecting flow velocity may become no less than 2 m/second.

As an ultrafilter 106, equipment described in Japanese Patent Application Publication No. 8-234358 may be suitably used. This ultrafilter 106 enables desalting operation without clogging compared with filters having micropores of other kinds, and gives excellent cleaning property of the filter after use, and has durability in repeated use. Collection efficiency of unnecessary salt is higher as compared with filters which have coarser pores. What is necessary is just to not let silver halide grain nuclei pass, as a filter of an ultrafilter, passing unreacted silver salt, unreacted halide salt, by-product salt generated by reaction, etc. Especially a filter made of ceramics is preferable.

A pAg sensor 148 is installed, and silver salt burette equipment 150 that stores silver salt solution for controlling pAg, and halide salt burette equipment 152 that stores halide salt are provided in the aging storage tank 128 shown in FIG. 1. Thereby, the pAg of silver halide emulsion when stored in the aging storage tank 128 is controlled to be constant. As a pAg sensor, a sensor described in Japanese Patent Application Publication No. 8-136499 may be suitably used. In this pAg sensor 148, a reference electrode used as basis of electric potential measurement is not directly put into a liquid for measuring, but is put into a warm bus at a fixed temperature that is precisely controlled within ±0.5° C. by a thermostat, and that is insulated, such as made of vinyl chloride, acrylate resin, or Teflon coated. Furthermore, the liquid for measuring and the reference electrodes is electrically conducted using a salt bridge, and only an end part of one indicator electrode is immersed into a liquid for measuring through ceramics having micropores, and another end part of the reference electrode and the indicator electrode are connected to a potentiometer to measure an electric potential.

EXAMPLE

Actual liquid capacity of the mixed tub of instantaneous mixing reactor in FIG. 2 (inner tub capacity+space capacity formed by outside tub and inner tub) was set as 25 mL. The inner tub rotated with a rotational speed of 3000 rpm, and a 5° C. silver nitrate aqueous solution having a concentration of 1.2826 mol/L was ejected out by 1.5 L/minute from one nozzle tubing, and from another nozzle tubing, a 10° C. potassium bromide aqueous solution in which low molecular weight gelatin 2.3% is dissolved and which has a concentration of 1.2836 mol/L was ejected by 1.5 L/minute, and mixing reaction was performed. A mixed liquor was discharged for 10 minutes from the outlet of outside tub. Thereby, silver halide grain nuclei were generated and a mother liquor of 30 L containing the silver halide grain nuclei was stored in the cooled tank. A liquid temperature in the cooled tank was controlled to be 10° C.

Next, when an amount in the cooled tank reached a desired production amount, the stored mother liquor was sent to the ultrafilter at a rate of 1.5 L/minutes by a pressure of 0.4 MPa, and the mother liquor after filtrated was discharged so that a filtrated amount might give 0.3 L/minutes. After the mother liquor discharged from the ultrafilter was heated to 45° C. with the heat exchanger, it was supplied to the convergent nozzle of the venturi tube type in-line mixer.

Formation of silver bromide fine grains for grain nuclei growth was performed using the continuous mixer of ultra high-speed jet type in FIG. 3. That is, a silver nitrate aqueous solution having a concentration of 1.2826 mol/L was ejected out to a junction area as a high-speed jet from the first small tube, and a potassium bromide aqueous solution having a concentration of 1.2836 mol/L was ejected out to the junction area as a high-speed jet from the second small tube. High-speed jets ejected out from the first and the second small tubes were passed through an orifice pore having a diameter of 0.18 mm under discharge pressure of 210 MPa. An ejecting flow rate of the silver nitrate aqueous solution at this time and the potassium bromide aqueous solution were 750 mL/minute, and rates of flow of jet were 491.5 m/second. A gelatin aqueous solution having a 1.8% of concentration was continuously introduced in fixed quantity by a flow rate of 140 mL/minute from the third small tube. As gelatin, low molecular weight gelatin having about 10,000 of molecular weight was used. Thereby, an addition liquid containing silver bromide fine grains for grain nuclei growth was prepared, and the addition liquid obtained was supplied to the addition nozzle of the venturi tube type in-line mixer, after being cooled to 30° C. with the heat exchanger.

In the venturi tube type in-line mixer, the mother liquor ejected out from the convergent nozzle, and the addition liquid ejected out from the addition nozzle were mixed instantaneously, and growing of grain nuclei was performed. A silver halide emulsion obtained by mixing the mother liquor and the addition liquid by the in-line mixer was continuously discharged into the aging storage tank, and when an amount of storage reached 1 L, agitator rotated, an emulsion liquid temperature was controlled to 38° C., and pAg was controlled to 8.9. The cross valve was switched when 50 L if silver halide emulsion was obtained, a grown silver halide emulsion in the aging storage tank was again sent at the rate of 1.5 L/minutes into a circulation line; ultrafilter→heat exchanger→in-line mixer→four way valve→aging storage tank→returning to ultrafilter; and a silver halide particle diameter was grown up to 0.580 micrometers. A standard deviation of the grain diameter at this time gave 0.008 micrometers, and an excellent silver halide grain emulsion having a narrow distribution range might be produced. Several production of silver halide emulsion of a desired amount of production were tried through production of lots having various charged amount, and in all lots, a silver halide emulsion having same performance might be produced.

As the Example indicates, although a wide particle size distribution is obtained by grain growth methods by conventional batch tank method, excellent silver halide emulsion having a narrow particle size distribution might be produced regardless of a charged amount, i.e., a production scale, by adopting a continuous grain growth method that repeats, if needed, a series of continuous operations in which if a mother liquor passes through a growth area of grain nuclei once, it will not pass through growth area again without next intended operation, as in the present invention. Thereby, a silver halide emulsion for photographs may be produced with stable and sufficient reproducibility on desired practical scale.

Therefore, a distribution ratio between grain nucleation and grain nuclei growth to an objective amount of silver used may be arbitrarily designed, and a degree of freedom in a prescription design of a silver halide emulsion production improves, and a silver halide emulsion having a high performance can be efficiently produced by smaller amount of silver.

As described above, according to a method for production and apparatus of a silver halide emulsion of the present invention, variation of charged amount accompanying production amount change does not affect photograph performance, a flexible production of an optimal amount corresponding to commercial scene needs may be performed, and a silver halide emulsion having monodispersibility may be produced with sufficient productivity.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A method for production of silver halide emulsion, comprising;

a grain nuclei forming step of performing a series of continuous operations comprising continuously, instantaneously mixing and causing reaction of a silver salt aqueous solution, a halide salt aqueous solution, and a hydrophilic dispersion medium aqueous solution to form a silver halide grain nuclei, and storing a mother liquor containing the silver halide grain nuclei in a cooled state until the amount of nuclei reaches a desired production amount of the silver halide emulsion; and a grain nuclei growing step of performing at least one series of continuous operation comprising filtering the cooled mother liquor to eliminate unnecessary salt generated in the formation reaction, and to dehydrate and concentrate the filtered mother liquor when the amount of product reaches a desired production amount, and continuously, instantaneously mixing the mother liquor after filtrated and an addition liquid containing silver halide ultrafine grains for growth obtained separately by mixing and reacting a silver salt aqueous solution, a halide salt aqueous solution, and a hydrophilic dispersion medium aqueous solution to grow the silver halide grain nuclei.

2. The method according to claim 1, wherein the filtration of the mother liquor is an ultrafiltration.

3. The method according to claim 1, wherein when a particle diameter of the silver halide grain nuclei is smaller than a desired particle diameter after one time of the grain nuclei growing step, the grain nuclei growing process is repeated until the diameter becomes the desired particle diameter.

4. The method according to claim 3, wherein the filtration of the mother liquor is an ultrafiltration.

* * * * *